US005702103A

United States Patent [19]

Salley

[11] Patent Number: 5,702,103

[45] Date of Patent: Dec. 30, 1997

[54] GAME BOARD HAVING MECHANICAL CHARACTERS

[76] Inventor: Sybil Salley, P.O. Box 452, Pinehurst, Tex. 77362

[21] Appl. No.: 541,831

[22] Filed: Oct. 10, 1995

[51] Int. Cl.[6] ..... A63F 3/00

[52] U.S. Cl. ..... 273/243; 273/238

[58] Field of Search ..... 273/237, 238, 273/242, 243, 248, 249

[56] References Cited

U.S. PATENT DOCUMENTS 3,085,803 4/1963 Krzes ..... 273/238
4,324,405 4/1982 Kruger, Jr. et al. ..... 273/238
5,162,009 11/1992 Vaughn ..... 273/238 X
5,251,904 10/1993 Cruz ..... 273/238 X
5,290,038 3/1994 Khin ..... 273/238 X

*Primary Examiner*—William E. Stoll
*Attorney, Agent, or Firm*—Gunn & Associates, P.C.

[57] ABSTRACT

A game board is shown having a playing surface with a map and a game playing path thereon. The players move their markers or talismen along the path. The path can be optionally a slot or groove, a series of peg holes, or a marked mileage strip. By a chance mechanism, player movement is determined. The preferred talisman carries a torch with simulated light from a bulb provided with battery power.

31 Claims, 3 Drawing Sheets

FIG. 10
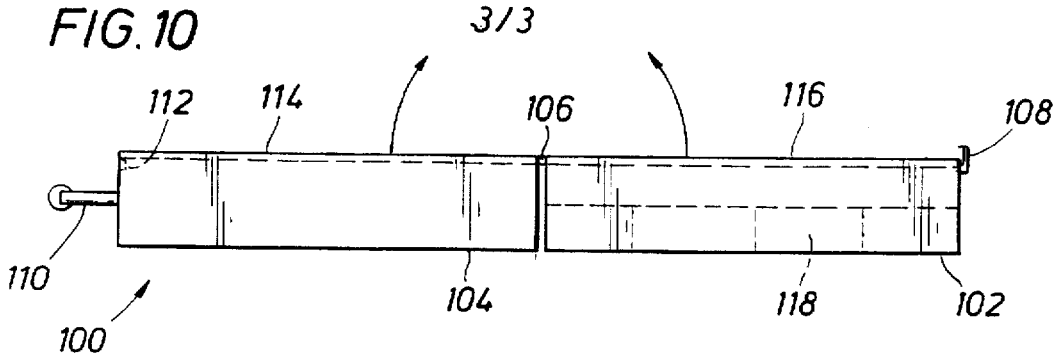
FIG. 11
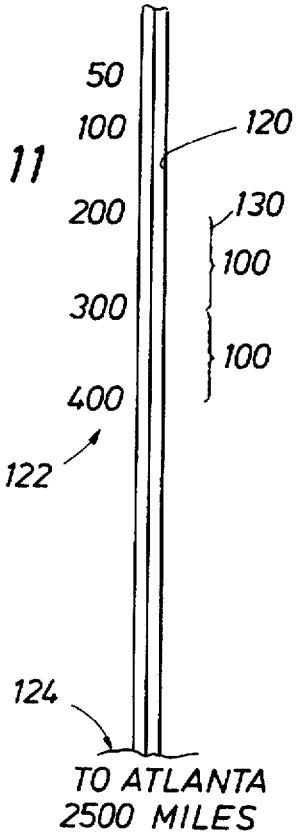
FIG. 12
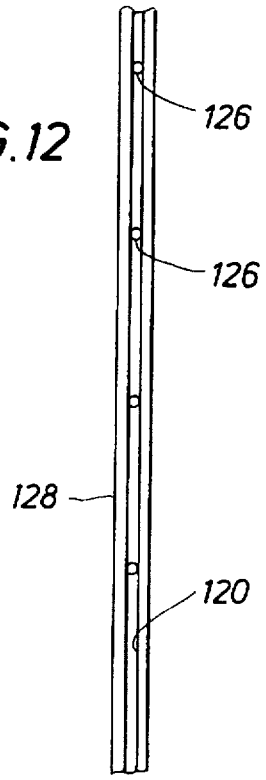
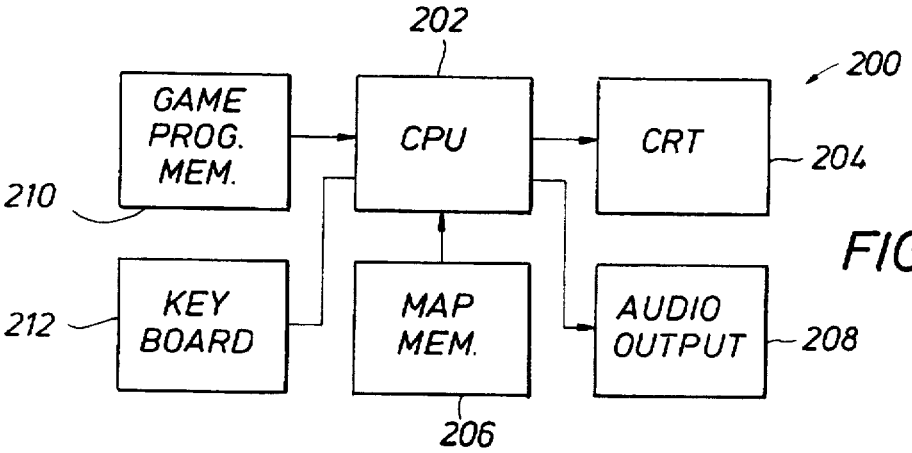
FIG. 13

GAME BOARD HAVING MECHANICAL CHARACTERS

BACKGROUND OF THE DISCLOSURE

The present disclosure is directed to a game, more specifically a board game and a board game which incorporates an element of chance for multiple contestants while playing the game in an Olympic style.

The board game of the present disclosure is a game which can involve two or more contestants for amusement in a game of chance and yet it is a geographic game showing a map of a selected portion of the world to provide the setting for the game or contest. The contest itself can be pursued by two or more contestants of any age from about 5 years and up or gender in the contest. More specifically, the contest involves two or more participants who contest for the prize, the prize finding correspondence to Olympic prizes. In one version, the prize is the privilege of lighting the cauldron in the stadium to signify commencement of the games. In other versions, the Olympic prize can include gold or silver medals, or reaching back into history, a garland or wreath reminiscent of the origin of the Olympics. The board game of the present disclosure provides a simulated game involving a talisman where each talisman is preferably marked or represents different contestants. Awards are gold, silver or bronze medals of the sort awarded in the current Olympics. While the game set might be packaged with any number of talisman which are stored in the game box when not in use, each talisman is moved along a game playing path on the board.

Considering this game for the U.S.A., the board game will have a game playing path across the map of the U.S.A. as discussed below. The map shows a region of interest as will be noted. Scale factors from the map will be noted and related to the game playing path. The appearance of the talisman is notable in that the talisman(s) ideally carries with it a battery and light bulb illuminated to simulate a torch bearer. More particularly, during the play, the participant can move his particular talisman from station to station along an assigned game playing path on the board. Perhaps this impact visually will be more clear on describing one set of rules involved in play with the board game.

One advantage of the present board game is it can be provided with multiple sets of game playing rules. A first example will be given in which the board game utilizes the context or setting of the Olympic games. In doing this, the game played follows the form or format of the Olympic games. Using the 1996 Olympic schedule, there is the transfer of an Olympic torch which is carried by relay runners from the origin of the Olympic games (historically in Greece) along a selected path over the earth. The 1996 Olympic games will involve a path extending approximately 15,000 miles or about 24,000 kilometers. The path will begin in Greece, and it will end at Atlanta for the 1996 games after having traveled approximately 2,500 miles across the U.S. At the termination of this torch transfer, the last runner will enter the stadium at which the games are located, and will ignite the Olympic torch at the stadium. As will be recalled, this has become a significant ceremony. In conformance with that protocol, the board game of the present disclosure incorporates components corresponding to the relay run across the U.S., transfer of the Olympic torch by runner after runner in the relay and ignition of the Olympic torch in the stadium accompanied by the usual pomp and ceremony. One aspect of the present game is a set of rules which enable the game to be played in a version which is true to history. Alternate aspects of the present board game and its play will be given. They will deviate from the historical context and are exemplified by various rules which will be delineated. With that in view, one set of rules will be described as the historical rules and other exemplary rules in contrast will be described as the modified rules.

The board game of the present disclosure is provided with a map. On the map, there is a game playing pathway from a start to a finish location where the path has a specified length. The length can be an arbitrary number of units such as 100 units, but it is better to present the length measured in kilometers or miles, an arbitrary distance being perhaps 2,500 miles. The U.S.A. game would have a game playing path of 2,500 miles with relay runners at each 200 mile interval, thus, the game would require thirteen on board runners. The winner could choose to use the last talisman to run the race to the stadium as attired or attire such talisman in a toga and wreath, select any board talisman of choice and/or choose one of ten final stadium relay representatives of five ethnic backgrounds and gender in toga attire with a laurel wreath thus making an additional ten talisman(s) bringing the total talisman to twenty three. The torch bearers in the relay for the 1996 games will cover 15,000 miles or 24,000 kilometers but using miles as a basis and making it applicable to kilometers would require about forty two talismen plus the modes of transportation (e.g., over the ocean) for the talismen. A particular player is provided with a talisman which is the marker for that player as the marker(s) or talisman(s) is moved between the start and the finish along the game playing path over the map.

The game playing path on the board is implemented in two or three different ways. In part, it can be marked across the map in color having the geometric form of a ribbon or strip and is a game playing path of specified length. To provide a more realistic game, the game playing path can be alternately made a slot or groove. In the slot, a marker(s) or talisman(s) can be positioned. The slot clamps the marker(s) or talisman(s) in the upstanding position. The slot can be continuous to permit sliding movement of the talisman along the slot. In one aspect of that approach, the slot can be provided with two separated electrical contacts along the interior of the slot suitable to enable a small voltage to be provided across a pair of conductive terminals. The terminals provide electrical power for illumination of the torch.

In another form of the board, the board is preferably relatively thick and is provided with a series of drilled holes of equal spacing and equal diameter. The holes are formed in a linear pathway in defining the game playing path on the board game. The drilled holes enable the marker(s), such as a peg supporting a talisman(s), to be positioned along the game playing path. More importantly, the progressive movement of the marker(s) is implemented by counting the number of pegged holes, e.g., three holes represent travel of three units of distance.

Participants in the game are provided with talisman(s). Each talisman is distinctively different by markings. For instance, they preferably have different uniforms and represent Olympic participants involved in different types of events including track and field, swimming, etc. Preferably, each talisman is provided with a national color or flag which is specific to the various countries. Each talisman preferably can carry a torch and is implemented in the form of an upstanding torch carrying runner. The talisman torch provides illumination. This illumination represents the lighted torch. The talisman is moved from location to location along the path. The talisman preferably has moveable legs which pivot with respect to an upstanding support or brace which adds an enhanced sense of realism. The arms may also pivot.

The several participants are provided with a chance determined indicator. This indicator enables the participants, in conformance with rules of the game, to move several moves along the game playing path by distances which are randomly determined. Dependent on the definition of the game, a winner is the person who moves his talisman to the finish before any other participant, achieves the highest score, or collects the most markers.

In an alternative aspect, the talisman of the winner can then be moved in front of a simulated grandstand to define a stadium for the winner to take a lap prior to igniting the stadium located flame. Several variations of the grandstand and stadium will be described in greater detail on review of the preferred embodiment which is described below.

In times past, the Olympics developed a culture which represented a fine tradition for amateur competition. This was lost and neglected according to the reports of history for nearly 1,900 years. Near the turn of the present century, the Olympic tradition was restarted and has continued to the present time except for a couple of interruptions. The Olympic tradition is particularly displayed by the preliminary event involving the transfer of the Olympic flame by torch from ancient Greece to the location of the Olympics. This is part of and a preliminary build-up in the initial ceremonies prior to the Olympic games which then follow. This is accomplished in part by transfer of the flame via a torch carried by multiple runners extending over a substantial distance. This torch relay can require up to about three months dependent on distance and other factors. As will be understood, this preliminary to the Olympic games sets the stage for the Olympic games (e.g., swimming and other contests) which then occur over a span of about three weeks. During that preliminary preparation, the torch is carried by runners who provide lofty imagery for the talisman used in the present game which includes an illuminated marker having the appearance of a torch bearer. A torch bearer is required to run the race along the game playing path from start to finish in the game and in a contest where the moves of the player are determined by a random game of chance. This enables young and old participants to play with relatively equal chances of winning. In other words, it is a board game in which players can span a wide age range including grandparents and relatively young children who have as much opportunity of winning as do the older generation.

In this context, the board game of the present disclosure is a device and a system enabling the players of the game to have a contest in the setting of a 2,000 year old tradition well founded in history.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 10 shows a game storage box;

FIGS. 11 and 12 show markings along the path on the board; and

FIG. 13 is a block diagram of a CPU based game.

DETAILED DESCRIPTION OF THE PREFERRED EMBODIMENT

The present disclosure is directed to a board game and more particularly to a board game which is played on the surface or face of the game board. A representative version is set forth in FIG. 1 of the drawings and is identified generally by the numeral 10. It is provided with an upper surface or face 12 which ideally includes a map on the face 12. The map shows a particular geographic area in a manner to be described. The map is placed on the face of the board to simulate the path of an Olympic torch bearer moving from ancient Greece to a designated city at which Olympic games are occurring. The map can readily be known or identified geographic areas including countries of Europe, perhaps Canada, the U.S. etc. As will be understood, the map is preferably printed on the face 12 and is distributed over the face so it covers substantially the greater portion of the board face 12. The map is thus useful in providing a geographic context for the game of the present disclosure.

Figure 1:
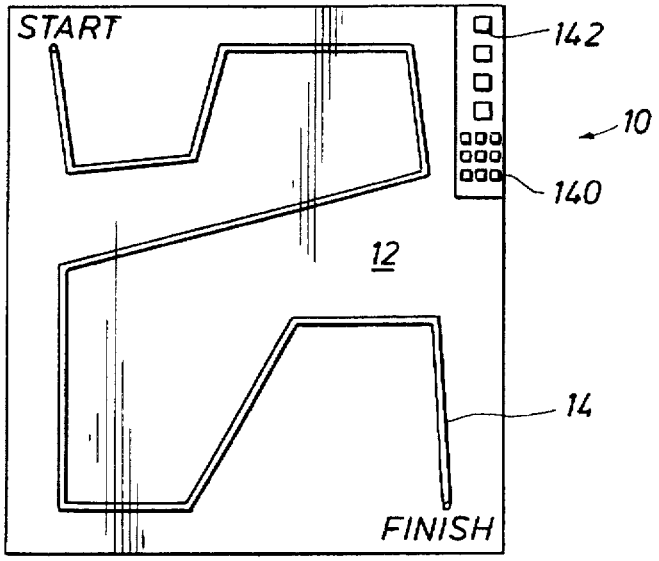
FIG. 1 shows a game playing board having a top surface wherein the board is marked with a game playing path on the surface which path extends from a start to a finish.

FIG. 1 shows a game playing path 14 formed of several different segments. The game playing path is marked on the map. The path 14 has a beginning point which is the start and extends to an ending point which is the finish shown in FIG. 1. This defines a game playing path of specified length, i.e., 2,500 miles. Developing this example, the game playing path 14 represents the pathway along which a torch bearer is required to travel over the map and hence over the country (or indeed several countries) through which the torch is carried. The several countries are illustrated on the map and in turn the path 14 extends over the map for a specified length. In the example given, the scale adapted for this particular Olympic games is 2,500 miles for the length of the path 14. As presently indicated, the path 14 is printed on the face 12 of the board 10. The path is formed of two or more line segments which sum to a specified scale distance, for example, the mentioned scale distance of 2,500 miles over the map of the U.S. Other embodiments will be detailed which utilize a recessed slot or groove or peg holes. That provides added features which will be developed in some detail hereinafter.

The present board game is intended for use by multiple participants in a contest for speed. In accordance with a set of rules developed for the board game 10, each player moves his marker or talisman (to be described) along the path 14. The game follows the path from start to finish. A winner is determined at the finish. The player is able to advance on the path 14 with an assigned marker. Play is path confined from start to finish. This is accomplished in the context of a simulated torch bearer relay moving over the map on the board. With multiple players, multiple random numbers control movement to traverse the pathway. It is customary to make the board relatively large so the map can be relatively large on the face of the board. Reasonably large dimensions are perhaps seventeen by twenty two inches. Even larger boards can be used, and they need not be precisely square. As a matter of convenience, a single board can be used which has the requisite playing area, but it is just as acceptable to provide a board which can be folded for ease of storage. In the latter event, it is common to divide the board through the center into two parts which fold for easy storage. In a bigger version, the board can be three or four parts. In any case, the board 10 is the playing surface on which several players contest for speed in traversing the game playing path 14 on the board. Moves of the players along the path 14 are determined by chance. One way to provide a controlled number of moves along the path 14 is through the use of a number generator described below.

FINISH OF THE RACE

Figure 2:
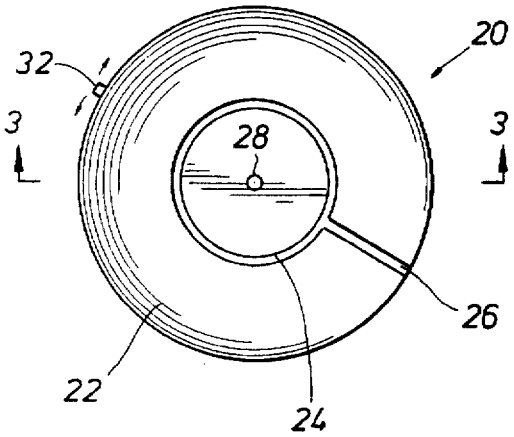
FIG. 2 is a plan view of a stadium to provide a simulated finish for games played on the board shown in FIG. 1 of the drawings.
Figure 3:
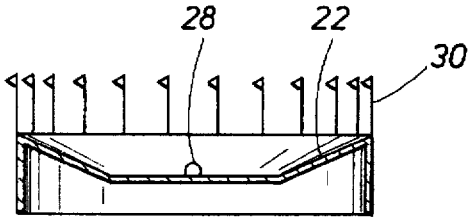
FIG. 3 is a sectional view along the line 3—3 of FIG. 2 showing added details of the stadium.

Attention is now directed to FIGS. 2 and 3 jointly which show a simulated stadium indicated generally at 20. The stadium 20 is shown to be a round stadium having simulated seats at 22. There is a stadium track 24. The stadium is provided with an entrance pathway 26. At the center, there is a simulated Olympic flame 28 which has the form of a lamp for illumination. The lamp 28 provides or mimics a flame. The stadium, also shown in FIG. 3, is equipped with a number of upstanding flag poles 30 with appropriate flags, banners, or pennants. This enables a victory lap to be taken around the track 24. The stadium 20 encloses a ceremony for the winner, this being subject to the rules of the game. In other words, the rules of the game permit the winner to take a ceremonial lap on the track 24. This can be done with the talisman as will be described.

Going therefore now to FIGS. 1 and 2 jointly, the player moves the marker or talisman along the game playing path 14 shown in FIG. 1. Both post-race and pre-Olympic events enable victory or ceremonial laps through the stadium on the track. Dependent on the rules, one or many of the players can move the various markers provided to them around the track 24. It adds to the procedure to incorporate a switch 32 on the stadium 20 which can be moved in the directions of the arrow marked in FIG. 2 to thereby turn on or off the lamp 28. Stadium activity by the winner or by all participants can be done in accordance with the rules of the game.

The stadium 20 is involved in the play after the prize is won. To this end and to provide a more realistic end play, the stadium can be serially installed at the end of the path 14 over the surface of the game board. Indeed, this game can be further enhanced by adding bleachers or standing crowds along the path 14. This takes into account the fact that the stadium 20 will have an attendant crowd of 100,000 people while the path 14 passes by only groups of perhaps 25 spectators, or in front of a small bleacher standing 5 or 6 rows tall.

Figure 4:
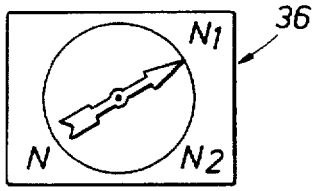
FIG. 4 is a spinner utilized in the game to assign arbitrary moves to participants.

In play, the game requires a random number generator to accomplish regular play. FIG. 4 of the drawings shows a spinner 36 which can be flipped by a player. As it spins and then stops, it will point to the numbers N at different locations around the spinner. The numbers N represent the number of units through which the talisman is advanced. If the path 14 in FIG. 1 simulates a 2,500 mile trip, the numbers N comprise a set on numbers ranging across some arbitrary range. Scaling this to a 2,500 mile path, the range is from some minimum to some maximum. Normally, the numbers N are whole number positive integers. The numbers N are scaled depending on the scale of the game.

One scale factor is tied to the 1996 Olympic schedule for Atlanta. The 1996 Olympic games involve a relay run of about 2,500 miles across the U.S. As will be understood, if a set of numbers N include numbers that are perhaps 10 or smaller, the game can become unduly lengthy. Therefore, and in context of the 2,500 mile torch relay that will be implemented in the U.S., the numbers N typically range for this scale between about 50 to 300. Note in the example just given the ratio between the largest and smallest numbers is 12:2 which corresponds to the range of numbers determined with a pair of dice. An alternate form of determining the move of a player can be through the use of a pair of dice. Each player gets to cast the dice and is provided with the random numbers in the range of two through twelve from a conventional pair of dice. That value may be scaled relatively up or down as required. For instance, the sum of the dice can be multiplied by 25. Also, the number generator can be a deck of cards (printed numbers on the face) where the numbers N forming a subset of distances are randomly mixed in the deck. The deck can be weighted to favor middle sized numbers and to avoid the largest and smallest numbers with the same sort of random distribution encountered with a pair of dice. An electronic number generator can also be used which provides a positive, whole number integer distributed between selected maximum and minimum values.

TALISMAN

Figure 5:
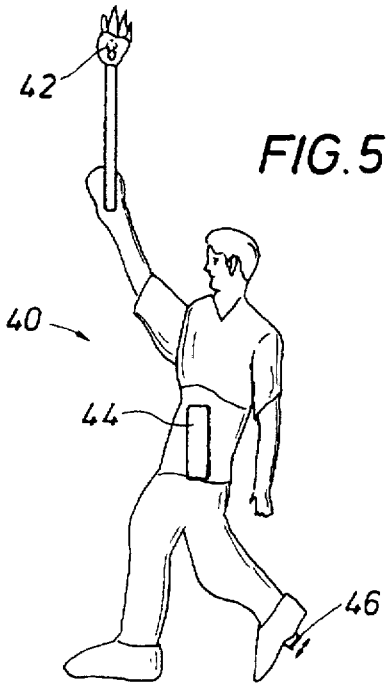
FIG. 5 is a side view of a talisman.
Figure 6:
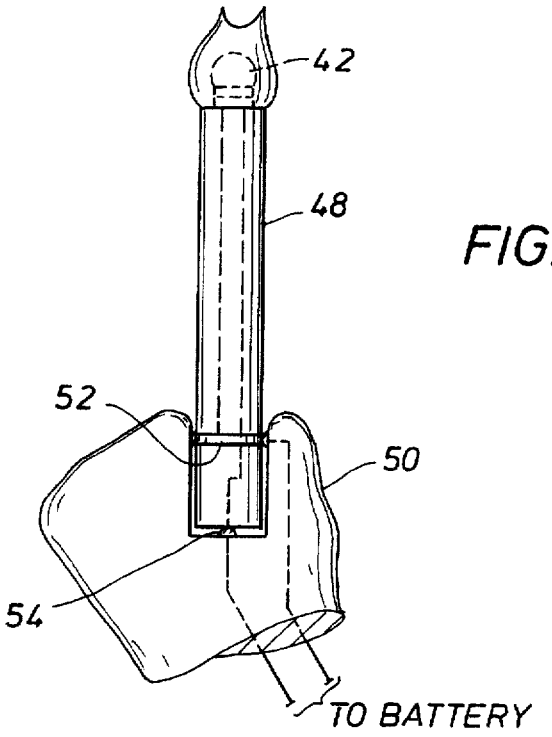
FIG. 6 is an enlarged view of a torch and hand.

Attention is now directed to FIGS. 5 and 6 of the drawings considered jointly. FIG. 5 shows the marker or talisman preferably formed as a small plastic casting or stamping. It is preferably marked with appropriate colors to provide a simulated torch bearer. A torch bearer is normally in uniform. The uniform preferably is the uniform of an Olympic contestant in some type event. The event may require special costuming. The torch bearer is a small marker with a base so it will stand upright. The torch bearer is carrying a torch as shown in FIG. 5. The torch provides a simulated flame. The flame is simulated by a small lamp located in the hand of the runner. The lamp in the hand of the runner provides the required illumination. Illumination requires a battery within the body of the torch bearer as represented in FIG. 5 in dotted line. Preferably, a convenient penlight cell is used so the light can be powered in a portable fashion. This requires the light to be switched on and switched off depending on the life of the battery and other details which relate to the visual attractiveness of the game.

Figure 7:
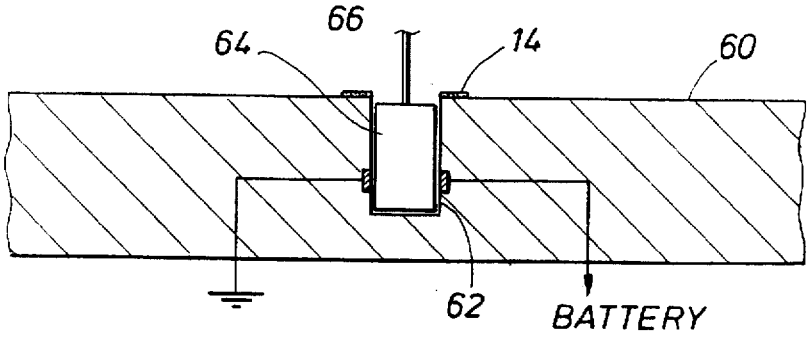
FIG. 7 is a sectional view through the game playing board showing a recessed slot along the game playing path so the talisman is held erect in the slot.

The marker of FIG. 5 stands in an upright position on the game board. The marker can be toppled or moved accidentally. To reduce the risk of toppling or accidental moving, FIG. 7 shows a groove which is along the game playing path 14. The path can be painted on the board and the groove is cut in the center of the path. When that groove is used, marker stability is enhanced. The stability derives from the ability of the groove to hold the marker in an upright posture. In this instance, the marker is then provided with an upstanding small wire and post which provides an anchor under the marker or talisman. In an alternate embodiment, the legs of the talisman are made moveable so they simulate a runner which enhances the realism of the marker movement along the path. The talisman 40 of the present disclosure is able to move with illumination from the bulb 42 provided with electrical power from the battery 44. If need be, a switch can be included for convenient concealment on the talisman and to this end, a switch 46 is illustrated.

Going again to FIG. 5 of the drawings, it is possible to delete the switch 46. The switch 46 can be deleted by utilizing a moveable torch. Such an example is shown in FIG. 6 of the drawings. There, the torch is removable. The torch itself includes the lamp providing the simulated flame. In FIG. 6, a bulb 42 is shown on an extended torch 48. It is removed from the hand 50. The base of the torch 48 includes electrical contacts 52 and 54. The two electrical contacts complete the circuit with wiring to a battery supported in the body of the talisman. As will be understood, the circuit is completed when the torch is plugged in. When it is removed from the hand, the circuit is broken and illumination is ended.

In an alternate fashion, the contact 52 need not go fully around; if it encircles only one half of the wand or stem for the torch, it can be rotated to a point of contact to turn the lamp on and rotated in the opposite direction to turn the lamp off.

BOARD CONSTRUCTION

Figure 8:
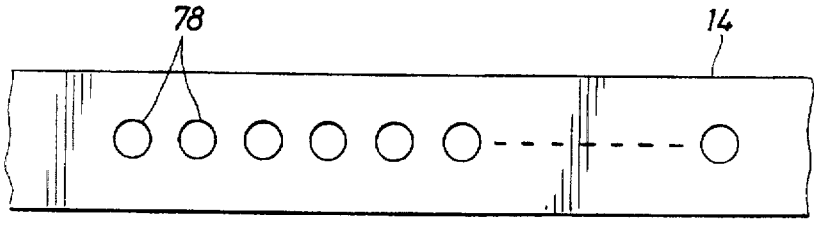
FIG. 8 is a plan view of the board with peg holes for the talisman.
Figure 9:
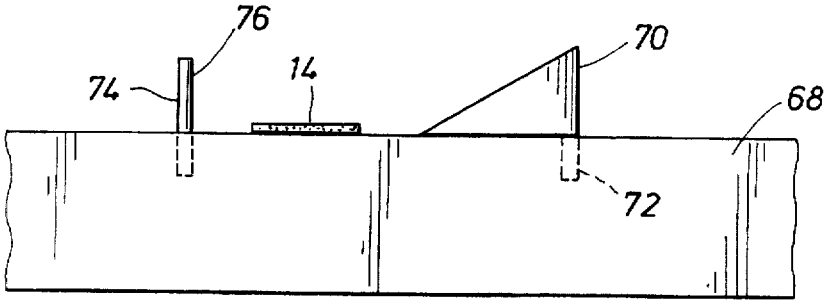
FIG. 9 is an edge view showing a bleacher or grandstand attached to the board.

Attention is now directed jointly to FIGS. 7, 8 and 9 which show alternate forms of the board construction. In FIG. 7 of the drawings, the game playing path 14 is embossed on the board 60 which has a relatively deep groove 62 formed in it. On the surface, the path 14 is visible to the participants in the form of a colored or raised path. The groove or slot 62 serves as a prop or support. A base 64 is inserted into the slot and held upright by friction, thereby supporting an upstanding support wire 66 connected to the talisman (omitted for sake of clarity). The base 64 is an elongate slidable shoe fitting in the groove. That construction enables a sliding movement. The distance along the game playing path can be marked on the face of the board 60. As desired, left and right contacts can be included to make electrical power available to the talisman; indeed, side or bottom contacts with the base 64 will do this to light the bulb 42.

Considering now FIG. 9 with FIG. 7, the game playing path 14 is printed or embossed on the board. The game playing path 14 on the board 68 proceeds past a spectator grandstand 70 which optionally plugs into the board 68 by means of spaced tabs 72 along the grandstand 70. This can be duplicated left and right on both sides of the path if desired. The stands 70 can be curved to follow the path if desired.

The grandstand 70 has an exposed and sloping face to simulate a straight or curved bleacher section of a few rows height. The realism can be enhanced by adding a few or even crowded spectators on the grandstand 70. On the opposite side of the path 14, the upstanding insert 74 represents a sparse crowd of spectators along the path 14. This is also tab mounted, and has an exposed face 76 with spectators on it.

Going now to FIG. 8 of the drawings, the game playing path 14 is shown in plan view. It is provided with a series of formed holes 78. The holes are spaced evenly and represent some suitable scale factor. By the use of a series of pegged holes in the path 14, the path can be extended by any length and carries with it the number of drilled holes 74 so that the game can be played. Depending again on scale factors, the marker of an individual player can be moved from one hole 78 to the next or by some other distance. In FIGS. 11 and 12, the path 14 includes the slot 120 which is measured by distance markers 122 or a color strip 128. The game is played with variable or fixed talisman positions 126 shown in FIG. 12. The path 14 extends to the finish 124, or by a distance of 2,500 miles in scale, ending at Atlanta in the 1996 games. The distance markers 122 measure the total distance to the finish (Atlanta), while, on the opposite side, spaced numbers 130 indicate a repeating measure, e.g., 100 miles.

Consider now the cooperation between the talisman and the board. One correlation is in the scale factor related to movement of the player.

GAME BOARD CARRYING CASE

Attention is directed to FIG. 10 of the drawings where the numeral 100 identifies a carrying box or carrying case for the present game board. More specifically, a lower box portion or container 102 is positioned opposite a top box portion or container 104. The boxes are joined together by one or more hinges 106 which enable the two box halves or portions to close together. A suitable latch 108 joins the two portions together when closed. When closed, the box can then be carried using the handle 110.

The game board is divided into two halves. It is rested inside a shoulder 112 which is located around the interior of the two box portions. This holds the left half of the game board 114 adjacent the right half of the game board 116. If convenient, the two halves of the game board can be joined together or held in the two box portions. In either case, the game can be played with the two halves of the game board in the box or they can be placed on a table for the sake of convenience. In another aspect of the box shown in FIG. 10, there are several compartments such as compartment 118 for holding paraphernalia. FIG. 10 shows with arrows the rotation of the box portions to the closed position. Indeed, the same rotation can be applied to the two halves of the game board which can be lifted out and placed on a table surface.

The board game (see FIG. 1) can be conveniently made of stock which is only a fraction of an inch thick. Even when thin, the board can easily include dedicated player controlled calculators at the edge of the board. For example, FIG. 1 shows a single player calculator having a keyboard 140 and LCD displays 142. This can be used to keep score during play. The board preferably has two or four of these calculators.

ELECTRONIC PLAY ON A SCREEN IMAGE

The game described to this juncture is set forth as a board game. Ordinary board components of construction can be used in the fabrication of the board game. As an example, a typical board game is formed of fiber board or some other type of relatively stiff board of appropriate rectangular size. On that, a map is printed. As further noted in the disclosure heretofore, the map is overlaid with a game playing path which has a start and a finish, and which has segments therebetween, thereby simulating a path of a specified length. Again, following on the example of the Olympic flame which is carried by relay where the flame (torch) is carried along a designated path across a particular geographic area, the relay transfers the torch which is carried from city to city, the relay extending over hundreds of kilometers, and an example was given where the torch is actually carried about 2,500 miles across the U.S.A. This involves a relay in which individual relay runners each carry the torch for a specified distance. In the play of the game, the torch is transferred from hand to hand as first and second talismen support the torch in an upraised hand for simulation of the Olympic torch relay. A small battery located in the talisman, or alternately connecting the talisman with an electrical circuit in a slot in the board provides power. Examples of this were given earlier so that the torch can be lighted. The torch is normally transferred from runner to runner and in this instance, that can also be done from talisman to talisman. To this end, the torch is normally plugged into and therefore removable from the hand of a torch bearer.

Again, and following on the model of the Olympic games, the torch is ultimately carried into a large stadium and is used to ignite the Olympic flame which burns during the games and which is later extinguished to indicate that the games have been terminated. In like fashion, the Olympic games protocol is applied in the game which is set forth here and described. In this particular aspect of the game, those features are preferably preserved. Attention is now directed to FIG. 13 of the drawings. There, the numeral 200 identifies an electronic mechanism by which the present game can be played. This incorporates CPU 202 which provides an output on a screen. That is represented on the CRT 204. The screen on the CRT provides appropriate images along the lines to be described. The system shown in FIG. 13 incorporates a map memory 206 which is preferably a CD ROM signal source. It can record any suitable map or region as appropriate. Indeed, it can show runners in different uniforms wearing different colors in different sports (depending on uniforms, flags, and the like) who are running along a road in the city or perhaps in the country. This should be true to the map that is provided on the screen. In other words, the memory stores scenes representative of an actual city. The screen thus provides as required the occasional glimpse of the city or the country or the crowds and other scenes that would normally be seen by a runner along the game playing path traced over the actual map. Preferably, the output includes an audio output from a speaker 208. Crowd noise is supplied including roaring crowds of 100,000 in a confined stadium, or perhaps 500 on the bleachers (FIG. 9), or the noise can be reduced to the timed foot fall of a solitary runner. The system also includes a game program memory 210. The game instructions are preferably stored in the form of software. That is stored in the form of instructions recorded on a memory device such as a 3.5" disc readable by well-known disc readers. In an alternate embodiment, the game playing instructions at 210 have the form of an insert or cartridge which is mated to and matched with the particular CPU so that the cartridge can be used exclusively with a particular CPU. By this technique, the game playing rules and regulations can be encoded in the cartridge and the cartridge can then be plugged in as the memory component 210 with a host system and can be swapped with other games so that the system 200 shown in FIG. 13 is not dedicated solely to this game. Rather, it can be used with this game or different games at different times by changing the rules of the game. Indeed, the system can take advantage of any number of cartridge mechanisms which are believed to be well-known.

The game of the present disclosure is therefore implemented using the screen to present the events. The screen typically will provide a first image during play illustrating a torch bearer who is running along the game playing path but in this instance, the path preferably forms reality on the screen and that reality covers at least one or two different situations. In one situation, an overview can be provided of the progress of the torch bearer along the path of hundreds of kilometers. It is possible to show just a part of the path. Indeed, the path can be shown as it actually exists across the map. FIG. 1 shows a representative game playing path where the path is made of a few straight line segments. This is somewhat idealized in comparison with the actual path which may follow a trail, a highway, a river valley and the like. Those paths are typically more crooked than the straight segments shown in FIG. 1 and some measure of reality can be kept with the game. In another enlarged view, so to speak, the individual runner can be shown running past certain scenery in the background. This can be stored in the CD ROM. To typify that type of run by the torch bearer, it is possible to record on the CD ROM scenes depicting the runner as the runner runs along a highway, down a trail, up or down hills and so on. These scenes can have greater reality and they represent more of a specific pathway. In this particular instance, this specific pathway is enlarged to show the runner. As will be understood, the runner can be shown for two or three minutes for each player as they take their different turns in the play of the game. Again, applying scale values to the situation, the background scenery of a few hundred yards can be shown on the screen as the runner travels along the game playing path on the screen. The overview can then be shown where the runner makes progress by some specified length (in kilometers or miles) along the game playing path that is idealized in FIG. 1 of the drawings.

The screen 204 is also used to periodically prompt the players. For instance, it can show the torch bearer running along a particular path for a specified interval accompanied by a crown noise as appropriate. Then, the scene can shift and provide a screen which prompts the next player to undertake the chance for advancement. Again and dependent on the rules of the game, the next player can then use the system 200 to determine the game move, i.e., the length of move for the next player.

For easy illustration, assume that there are four players, and they input their names through a keyboard 212. To extend the example, assume that the four players are Al, Bob, Chuck, and Donna. They can input their names so the game program memory 210 will record the names and then instruct them in order. If the order of play is in the order just given, the screen 204 will instruct first Al and then Bob to determine by chance their next move. One effective screen is to provide a prompt to the particular contestant to determine game move by chance. The next screen for that contestant will provide instructions on how to generate the random number. There are several ways to generate a random number utilizing random number generator programs which are believed to be well-known. After that number has been generated, it can then be implemented by moving for that particular contestant the distance which is indicated. Again, and using the scale of kilometers, assume that the move instructs the player to advance by 40 kilometers. As will be understood, each of the four contestants will operate the game of chance, triggering the chance generator time and again and winning distances in accordance with the rules of the game. If need be, this distance can be kept on a piece of paper on the side but it is probably more convenient to provide a screen which shows the advance of several players with columns labelled for Bob or Donna as the case may be. When the finish in accordance with the rules of the game is accomplished, another screen can then provide an image of the victor indicating the name of the victor, the winning score in accordance with the rules of the game and other information like that. If desired, a set of two or more dice (marked with numbers) can be used to determine distance. Also, a stack of number cards is shuffled and drawn (face down) to get the move length. All of these are CPU generated and shown on the screen.

The present game is somewhat different in the enhancement of an award path which extends beyond the game playing path. The award path finds correspondence to the entry of a torch bearer into the stadium so that the last torch bearer initiates a ceremony of great historical significance before 100,000 spectators. In the play of this game, the winner is awarded that event. That involves the extension of the game playing path to implement or execute the award. Again, all this can be shown on the screen using recorded images from the map memory, images of the stadium complete with crowd and crowd noise. This makes up a significant part of the game utilizing the electronic mechanism shown in FIG. 13.

HISTORICAL RULES

The historical rules relating to the board game are directed to the recreation of the start of the Olympics. This involved the Olympic transfer by which the Olympic flame is moved from the origin in Greece. It is moved along by runner relay handing the torch from runner to runner. The runners carry the torch in serial fashion, handing the torch to the next runner. Historically, the runners run along announced roads through specified cities, towns and regions. Along the route, observers typically watch the runners as they pass. In accordance with the present board game and utilizing the historical rules, two or more game players or contestants can play in accordance with the following historical rules. Preferably they have sufficient age to be able to count and pay attention to the game. One contestant is selected by chance to begin the game. Conveniently, all of the players operate a spinner to attain a high score. The player with the highest score makes the first move. The second and additional players sequentially make their moves after the first based on the scores attained by chance. This move is made with a torch bearer by each player. The player that lands along the game playing path at the exact location of the upcoming torch bearer earns the torch bearer the player was then using, and receives a bonus of an additional measure along the game playing path. The player who overtakes the last torch bearer or covers the most distance wins the right to move the torch bearer to the center of stadium (discussed below) and to ignite the Olympic flame that corresponds to the flame left at the stadium. By definition in the rules, the winner can be defined and award(s) given by changing the game playing rules.

RULES OF THE GAME

The game is suitable for two, three or four players, ages five to adult. The object of the game is to move one or more of the torch bearers and to cover the most mileage.

The player to begin the game is determined by the highest score achieved on the spinner. This score is used in the player's first move. The second, third, etc. players take their turns and move predicated on their scores. The player who lands on the exact location of the upcoming torch bearer earns another 100 miles and also earns the torch bearer he has been playing with.

The player who overtakes (goes beyond the upcoming torch bearer) wins the torch bearer he has been playing with.

The player who overtakes the last torch bearer direct on center wins the right to move the torch bearer directly to the stadium and light the center torch, earning the mileage from that interception point of the stadium. If the player overtakes the last torch bearer and the player's score places him still away from the stadium the player wins an additional fifty miles. The player who reaches the final torch bearer dead on center may choose from male, female, state, ethnic background, and/or toga attire with a laurel wreath attached to torch bearer's head to race forward to the stadium.

The present disclosure will show a map of the U.S. and a map of the world in two separate games. The torch bearers will run and use other means of conveyances such as train, plane, helicopter, cruise liner, tramp steamer, kayak, canoe, paddle wheel, aircraft carrier, horse back, dog sled, etc. The torch bearer and the mode of transportation would be manufactured to have snap together means and magnets which would hold them together, etc.

To protect the owner of any of these collectibles, each game would contain an numbered and dated scroll for authenticity.

While the foregoing is directed to the preferred embodiment of the present invention, other and further embodiments of the invention may be devised without departing from the basic scope thereof, and the scope thereof is determined by the claims which follow.

What is claimed is:

1. A game comprising:
   (a) a board having a top located game playing surface;
   (b) one or more game playing paths comprising left and right walls defining an elongate even width receptacle on said game playing surface wherein said path has
      (i) a start position;
      (ii) an end position; and
      (iii) an intermediate portion connecting to said start and end positions with said elongate receptacle therebetween;
   (c) a talisman for use by a player to move along said playing path and having
      (i) a base suitable to rest on said path between said left and right walls;
      (ii) a lamp; and
      (iii) means to illuminate said lamp; and
   (d) a chance determined talisman move generator operated by a player to control talisman movement.

2. The game of claim 1 with marked distances and left and right talisman guide walls along said path.

3. The game of claim 2 with a grandstand or bleachers with spectators.

4. The game of claim 2 with two or more player dedicated score indicators to keep score as two or more players proceed in accordance with the rules of the game.

5. The game of claim 2 wherein tailsmen are marked and said game play is accompanied by sound.

6. The game of claim 1 including N units length where N is a whole number integer along said path in accordance with the rules of the game.

7. The game of claim 6 wherein said path end point is in a stadium.

8. The game of claim 1 wherein said path enables multiple talismen to uniquely and independently play along said path.

9. The game of claim 1 with marked distances along said path.

10. The game of claim 9 with two or more player dedicated score indicators to keep score as two or more players proceed in accordance with the rules of the game.

11. The game of claim 10 wherein talismen are marked and said game play is accompanied by sound.

12. The game of claim 9 including N units length where N is a whole number integer along said path in accordance with the rules of the game.

13. The game of claim 9 wherein said elongated receptacle has left and right talismen guide walls.

14. The game board of claim 1 further including a map on said game playing surface wherein said marked game playing path is marked on said map and connects with identifiable geographic places on said map.

15. The game of claim 14 wherein said talisman support receptacle comprises an elongate slot between said left and right walls and coincident with said game playing path.

16. The board game of claim 15 wherein said slot incorporates said left and right walls cooperating with said talisman to enable said talisman to stand upright before and after movement along said slot.

17. The board game of claim 16 wherein said receptacle comprises a series of spaced similar holes in said game board sized to support a talisman connected plug to enable said talisman to extend upright.

18. The board game of claim 15 wherein said slot incorporates sidewalls cooperating with said talisman to enable said talisman to stand in designated locations along the pathway before and after movement along said slot.

19. The board game of claim 1 wherein said board has a recessed groove comprising said receptacle; and said groove is deployed over a map on said game playing surface to simulate a relay run over a long distance on the map.

20. The game board of claim 1 wherein said board is formed by two portions and said portions join at a hinged straight edge to enable said two portions to fold, thereby closing the game playing surface.

21. The apparatus of claim 20 wherein said closed game board portions are held together by a latch.

22. The apparatus of claim 20 wherein said portions form a carrying case having a handle when closed by rotation about said hinge.

23. A game comprising:

(a) a game board having a game playing surface;

(b) a marked game playing surface having one or more game playing paths defined by left and right walls in an elongate receptacle in said game board wherein said path has (i) a start position;

(ii) an end position; and (iii) an intermediate portion connecting to said start and end positions;

(c) a talisman for play by a player on said path and supported on a base positioned in said receptacle and said base electrically contacts said left and right walls for power;

(d) a chance determined talisman move generator operated by a player to control talisman movement; and (e) said recess comprises a recessed talisman support extending along said game playing path to enable said talisman to be electrically powered thereby.

24. The game of claim 23 wherein said talisman support receptacle comprises an elongate slot coincident with said game playing path.

25. The board game of claim 24 wherein said slot incorporates sidewalls cooperating with said talisman to enable said talisman to stand upright before and after movement along said slot.

26. The board game of claim 24 wherein said slot incorporates sidewalls cooperating with said talisman to enable said talisman to stand in designated locations along the pathway before and after movement along said slot.

27. The board game of claim 23 wherein said recessed talisman support receptacle incorporates electrical terminals therein to enable electrical connection with said talisman through said receptacle, and further wherein said talisman includes a lamp which is illuminated electrically.

28. The board game of claim 23 wherein said board has a recessed groove comprising said receptacle; and said groove is deployed over a map on said game playing surface to simulate a relay run over a long distance on the map.

29. The board game of claim 28 wherein said groove comprises a slot in said board fitting around a talisman base.

30. The board game of claim 29 wherein said groove is formed along a simulated measured distance.

31. The board game of claim 23 further including a game board containing box having two openable portions positioned to open and display said game board therein and to close to secure said game board when not in use, and said box further includes a recessed compartment therein to secure at least one talisman when not in use.

* * * * *